United States Patent [19]

Hayashida et al.

[11] Patent Number: 5,051,739

[45] Date of Patent: Sep. 24, 1991

[54] DRIVING CIRCUIT FOR AN IMAGE DISPLAY APPARATUS WITH IMPROVED YIELD AND PERFORMANCE

[75] Inventors: Toshiaki Hayashida, Hirakata; Hajime Takesada; Mitsuhiro Yamasaki, both of Kobe, all of Japan

[73] Assignee: Sanyo Electric Co., Ltd., Osaka, Japan

[21] Appl. No.: 411,234

[22] PCT Filed: May 12, 1987

[86] PCT No.: PCT/JP87/00294

§ 371 Date: Dec. 16, 1987

§ 102(e) Date: Dec. 16, 1987

[87] PCT Pub. No.: WO87/07067

PCT Pub. Date: Dec. 19, 1987

Related U.S. Application Data

[63] Continuation of Ser. No. 143,556, Dec. 16, 1987, abandoned.

[30] Foreign Application Priority Data

| | | | |
|---|---|---|---|
| May 13, 1986 | [JP] | Japan | 61-108969 |
| May 20, 1986 | [JP] | Japan | 61-115076 |
| May 20, 1986 | [JP] | Japan | 61-115077 |
| May 20, 1986 | [JP] | Japan | 61-115078 |
| May 20, 1986 | [JP] | Japan | 61-115079 |
| May 20, 1986 | [JP] | Japan | 61-115080 |
| Sep. 17, 1986 | [JP] | Japan | 61-219982 |

[51] Int. Cl.[5] ..... G09G 3/36

[52] U.S. Cl. ..... 340/784; 340/811

[58] Field of Search ..... 340/718, 719, 765, 784, 340/783, 785–788, 811; 350/331 R, 332, 333; 358/230, 236, 241

[56] References Cited

U.S. PATENT DOCUMENTS

| | | | |
|---|---|---|---|
| 3,781,864 | 12/1973 | Fujita . | |
| 3,988,616 | 10/1976 | Shimada | 340/784 |
| 4,308,534 | 12/1981 | Yamamoto | 340/784 |
| 4,556,880 | 12/1985 | Hamada | 340/784 |
| 4,582,395 | 4/1986 | Morozumi | 340/784 |
| 4,633,242 | 12/1986 | Sekiya | 340/719 |
| 4,644,338 | 2/1987 | Aoki et al. | 340/784 |
| 4,707,691 | 11/1987 | Hammura et al. | 340/784 |

FOREIGN PATENT DOCUMENTS

| | | |
|---|---|---|
| 47-22094 | 10/1972 | Japan . |
| 53-116742 | 10/1978 | Japan . |
| 54-154992 | 12/1979 | Japan . |
| 56-87089 | 7/1981 | Japan . |
| 60-106278 | 6/1985 | Japan . |
| 1371990 | 10/1974 | United Kingdom . |

OTHER PUBLICATIONS

"18.3: A 240×360 Element Active Matrix LCD with Integrated Gate Bus Drivers Using Poly-Si-TFTs", Oana, pp. 312–315, SID 84 Digest.

"18.4 4.25 in. and 1.51 in. B/W and Full Color LC Video Displays Addressed by Poly-Si-TFTs", Morozumi et al., pp. 316–319, SID 84 Digest.

"5.6: An Active-matrix LCD with Integrated Driver Circuits Using a-Si TFTs", pp. 212–215, Japan Display '86.

*Primary Examiner*—Jeffery A. Brier

*Attorney, Agent, or Firm*—Armstrong, Nikaido, Marmelstein, Kubovcik, & Murray

[57] ABSTRACT

A driving circuit for an image display apparatus wherein the respective rows and columns of the active matrix panel with a plurality of picture elements disposed on the matrix shape are respectively selected by the clock pulses of the given frequency to drive each of the picture elements. A counter which counts the clock pulses to introduce the binary count values and the inversion outputs, and a decoder which decodes the counter outputs to generate the pulses that sequentially shift in synchronous relation in the clock pulses are provided to feed the counter output from both the ends of the code signal line of the decoder so that the decoder may be always operated normally.

6 Claims, 14 Drawing Sheets

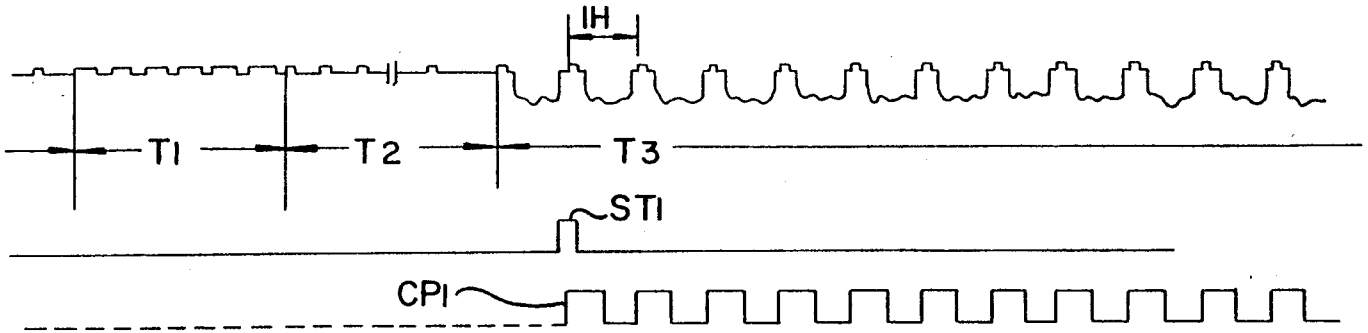
Fig.16(a)
Fig.16(b)
Fig.16(c)
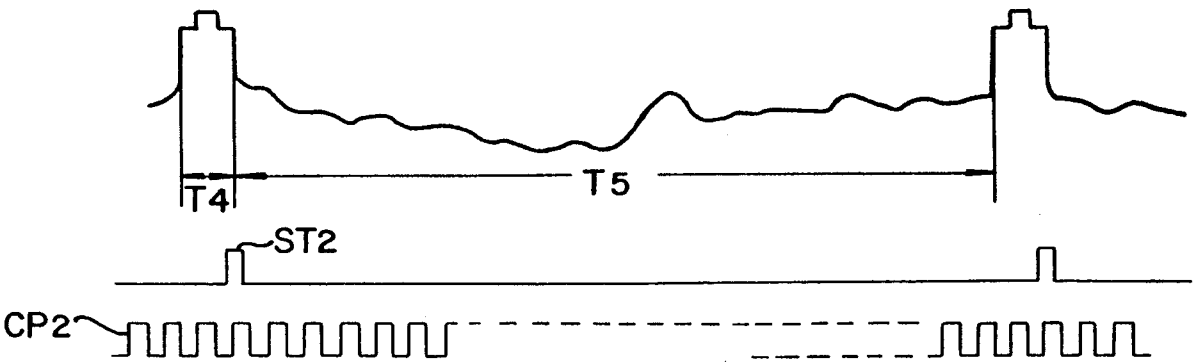
Fig.17(a)
Fig.17(b)
Fig.17(c)

DRIVING CIRCUIT FOR AN IMAGE DISPLAY APPARATUS WITH IMPROVED YIELD AND PERFORMANCE

This application is a continuation of application Ser. No. 143,556, filed Dec. 16, 1987 now abandoned.

TECHNICAL FIELD

The present invention relates to a driving circuit for the image display apparatus of liquid-crystal matrix panels.

BACKGROUND OF THE INVENTION

FIG. 18 shows the driving circuit for the liquid-crystal display apparatus by the active matrix liquid-crystal panels to be used in the liquid-crystal TV apparatus. Such a circuit as described hereinabove is described in, for example, Japanese Patent Application Laid-Open Publication Tokkaisho No. 57-41078.

In the same drawing, the liquid-crystal panel 1 of the active matrix type has n column of picture elements in the X direction and m row of picture elements in the Y direction. The TFTs (thin film transistors) la composed of m×n amorphous silicons (a-Si) and the liquid-crystal electrodes 1*b* are connected in matrix shape as shown with the respective rows G1, G2, ... Gm and the respective columns D1, D2, Dn being respectively connected with the row driver 2 and the column driver 3. The row driver is composed of the m stage of shift register 2*a* and output circuit 2*b*. The column driver is composed of the n stage of shift register 3*a*, the sampling hold circuit 3*b* and the output circuit 3*c*. The synchronization controlling circuit 4 generates the first and second start pulses ST1 and ST2 and the first and second clock pulses CP1 and CP2 in accordance with the horizontal synchronizing signal $H_P$ and the vertical synchronizing signal $V_P$.

The first start pulse ST1 synchronized with the vertical synchronizing signal and the first clock pulse CP1 synchronized with the horizontal synchronizing signal are fed into the shift register 2*a*, the voltage waveforms shifted 1H (1 horizontal period) by 1H are applied upon each row G1, G2, ... . The TFTs 1*a* of each line are sequentially turned on in the horizontal retrace section by the voltage waveform to apply the liquid-crystal driving voltage upon each picture element.

On the other hand the column driver repeats the same operation in each 1H section.

The second start pulse ST2 synchronized with the horizontal synchronizing signal and the second clock pulse of the frequency of the period $\tau = T5/n$ are fed into the shift register 3*a*, the pulse sequentially shifted $\tau$ by $\tau$ is output to the output of each stage of the shift register 3*a*. Each stage of the sample holding circuit 3*b* is controlled by the output of the shift register of each of the corresponding stages, the voltage value of the image signal is sampled by the falling of the output to hold it till the sampling time (for 1H). The output circuit 3*c* receives the output of the sampling hold circuit to buffer-amplify to drive the column electrode.

The shift register in the above-described driving circuit is of a construction as shown in FIG. 19. As the transfer of the data, as apparent from FIG. 19 (the drawing shows one stage portion), is performed through the sequential switching operation of four transistors per stage of the shift register by clock $\phi,\phi$, the delay time per stage of transistor is required to be within one fourth of the clock period for the operation.

Namely, as the comparatively fast switching speed is required for the transistor, the transistor of the slow switching speed like the a-Si TFT in use for the liquid-crystal panel 1 can not be used.

OBJECTS OF THE INVENTION

Accordingly, an object of the present invention is to provide a transistor of comparatively slow switching speed in one portion of the driving circuit.

Another object of the present invention is to reduce the consumption power of the driving circuit.

A further object of the present invention is to provide a driving circuit where a large transient current does not flow to the output circuit when the output signal is switched, and the switching time does not become long.

A still further object of the present invention is to properly operate the panel and to improve the yield even if something goes wrong with the matrix panel or the driving circuit.

SUMMARY OF THE INVENTION

The present invention provides a driving circuit for the image display apparatus, wherein the respective rows and columns of the active matrix panel with a plurality of picture elements being disposed in the matrix shape are respectively selected by the clock pulses of the given frequency to drive each of the picture elements. The present invention is characterized in that a counter for counting the clock pulses to introduce the binary count values and their inversion outputs, and a decoder for decoding the counter outputs to generate pulses, which sequentially shift in synchronous relation with the clock pulses, into the respective rows or the respective columns are provided. The switching transistor constituting the decoder is formed as a thin film transistor on the same base plate as the active matrix panel. Accordingly, the driving circuit is composed of a counter which is adapted to count the clock pulses to introduce the binary count values and their inversion outputs, a decoder which is adapted to generate the pulses that sequentially shift in synchronous relation with the clock pulses into the respective rows and/or the respective columns of the matrix panel, so that the time required for the switching operation of the switching transistor within the driving circuit is adapted to become shorter by the above-described means.

BRIEF DESCRIPTION OF THE DRAWINGS

These and other objects and features of the present invention will become apparent from the following description taken in conjunction with the preferred embodiments thereof with reference to the accompanying drawings, in which:

FIGS. 16(*a*) through 16(*c*) are waveform charts in each portion of the row driver of FIG. 1;

FIGS. 17(*a*) through 17(*c*) are waveform charts in each portion of the column driver of FIG. 1;

DETAILED DESCRIPTION OF THE INVENTION

Figure 1:
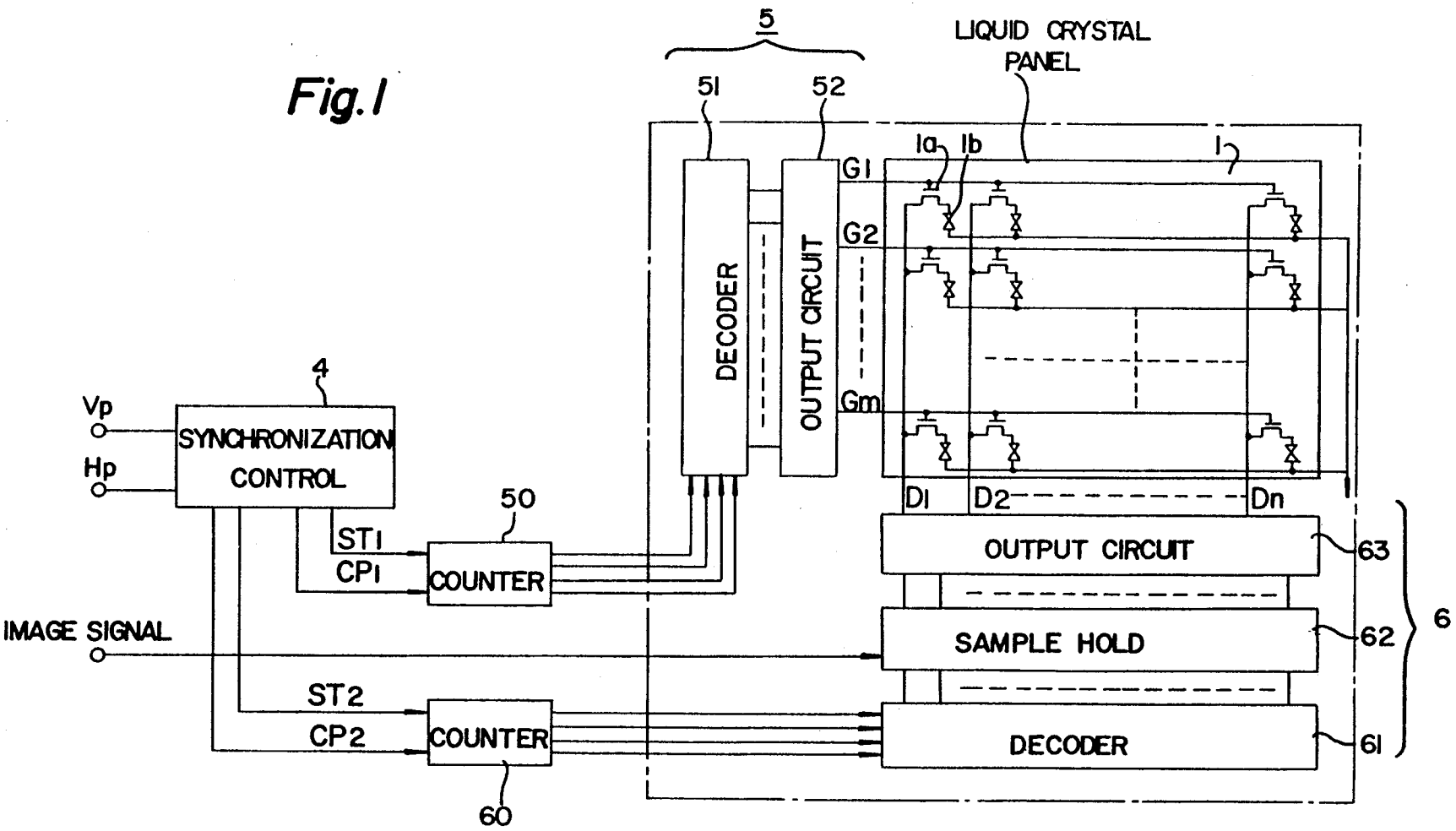
FIG. 1 is a block diagram showing a driving circuit for a liquid-crystal display apparatus by the active matrix liquid crystal panel to be used in the liquid crystal as a first embodiment of the present invention.

Before the description of the present invention proceeds, it is to be noted that like parts are designated by like reference numerals throughout the accompanying drawings.

(First Embodiment)

Referring to the drawings, there is shown in FIG. 1 a block diagram showing a driving circuit for a liquid-crystal display apparatus with an active matrix liquid-crystal panel to be used in a liquid-crystal TV apparatus according to a first preferred embodiment of the present invention, which includes a liquid-crystal panel 1, output circuits 52, 63, a sample holding circuit 62, decoders 51, 61, a synchronization controlling circuit 4, and counters 50, 60.

The active matrix type of liquid-crystal panel 1 has picture elements of n column in the X direction, m row in the Y direction, a TFT (thin film transistor) 1*a* and a liquid-crystal electrode 1*b* composed of an amorphous silicon (a-Si) of m x n connected into a matrix shape as shown. The respective rows G1, G2, ... Gm and the respective columns D1, D2, ... Dn are respectively connected with row driver 5 and a column driver 6. The row driver 5 is composed of a decoder 51 and an output circuit 52. The column driver 6 is composed of a decoder 61, a sample holding circuit 62 and an output circuit 63. The synchronization controlling circuit 4 generates the first and second start pulses ST1 and ST2 and the first and second clock pulses CP1 and CP2 in accordance with horizontal synchronizing signals $H_P$ and vertical synchronizing signals $V_P$.

FIGS. 16(*a*)–16(*c*) show each waveform of the row driver 5, FIG. 16(*a*) shows a picture signal with a vertical synchronizing signal $V_P$ and a horizontal synchronizing signal $H_P$ being placed one upon another. In the drawing, reference character T1 shows the vertical synchronizing signal section, reference character T2 shows the vertical retrace section, and reference character T3 is the picture signal section.

On the other hand, each portion waveform of the driver 6 is shown in FIGS. 17(*a*)–17(*b*). The column driver repeats the same operation in each 1H section. FIG. 17(*a*) is a picture signal wherein 1H section in T3 is expanded and drawn. In the drawing, reference character T4 shows a horizontal retrace section and reference character T5 shows the picture information-contained section.

The second start pulses ST2 synchronized with the horizontal synchronous signal shown in FIGS. 17(*b*) and 17(*c*), and the second clock pulses of the frequency of the period $\tau = T5/n$ are fed to the counters 50 and 60.

The counter 50, which is the first counter, starts the counting operation of the first clock pulses CP1 with the first start pulse ST1 from the synchronization controlling circuit 4 to output the binary count outputs A and B and to output the inversion outputs $\overline{A}$ and $\overline{B}$. This counter is composed of IC:LC4520B and LC4049B manufactured by Tokyo Sanyo Electric Co., Ltd. The decoder 51 is the first decoder, which decodes the first counter output to respectively output the pulses that become high sequentially for each of the first clock pulses CP1 to the right and left of each row G1, G2, ... . The counter 60 is the second counter, which is adapted to output the binary outputs in accordance with the second start pulse ST2 and the second clock pulse CP2 from the synchronization controlling circuit 4. The decoder 61 is the second decoder, which decodes the second counter output to output the pulses that become high sequentially for each of the second clock pulses CP2 to each column D1, D2, ... . The row driver 5 is composed of the first counter 50, the first decoder 51 and the output circuit 52. The column driver 6 is composed of the second counter 60, the second decoder 61, the sample holding circuit 62 and the output circuit 63. The first and second decoders 51 and 61, the output circuits 52 and 63, and the sample holding circuit 62 are formed of the a-Si TFT in the same process and on the same base plate as on the liquid-crystal panel 1.

The circuit of the first decoder and the operation of the row driver will be described with reference to FIG. 2. Each row of the binary count outputs A and B from the first counter 50 and the inversion outputs $\overline{A}$ and $\overline{B}$, and each row G1, G2, ... are crossed in the matrix shape with two TFTs composing an AND gate being disposed in series in each row. In addition, each row has loads TFT T9 through T12 connected therewith. The output circuit 52, which has such construction as shown in FIG. 3, is connected with the outputs for each of the rows.

Now, when the counter output is "00", A and B are both "0", $\overline{A}$ and $\overline{B}$ are both "1" to turn on the TFTs T1, T2, T4 and T5, with only the row G1 becoming high. Then, when the counter output is "01", both A and $\overline{B}$ are "0", both $\overline{A}$ and B are "1" to turn on the TFTs T2, T3, T4 and T7, with the row G2 becoming high. Upon sequential increment of the counter output like this, the next row becomes sequentially high so as to be selected and to be amplified in reversion in the output circuit of the next stage, and thus the TFTs within the liquid-crystal panel of this row.

When the driving operation of all the rows is completed, and the first counter 50 is reset by the next start signal, the scanning operation of the next frame is started.

Figure 4:
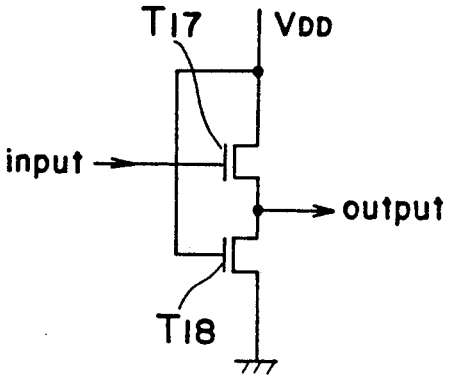
FIG. 4, FIG. 5 and FIG. 6 are, respectively, circuit diagrams each showing a modification of the output circuit of FIG. 3.

FIG. 4 shows a circuit diagram of one row portion of the output circuit in the present embodiment. A first FET T17 for amplification and a second FET T18 for loading are longitudinally connected between the power supply $V_{DD}$ and ground, the gate of the second FET T18 being connected with the power supply $V_{DD}$. The input signal is applied upon the gate of the first FET T17 so that the output signal is output from the connection point between the first and second FETs T17 and T18. With the circuit of FIG. 4, when the input signal is high, the first and second FETs T17 and T18 are turned on, thus the output becomes high. At this time, the current does flow to the output gate circuit constituted by the first and second FETs T17 and T18.

On the other hand, when the input signal is low, the first and second FETs T17 and T18 are turned off, thus resulting in the low output. At this time, the current does not flow into the output gate of the first first and second FETs.

Accordingly, in the present embodiment, the current flows to the output circuit of one row portion selected from among two hundred forty rows, but the current does not flow at all to the output circuit of the other two hundred thirty-nine rows.

Figure 5:
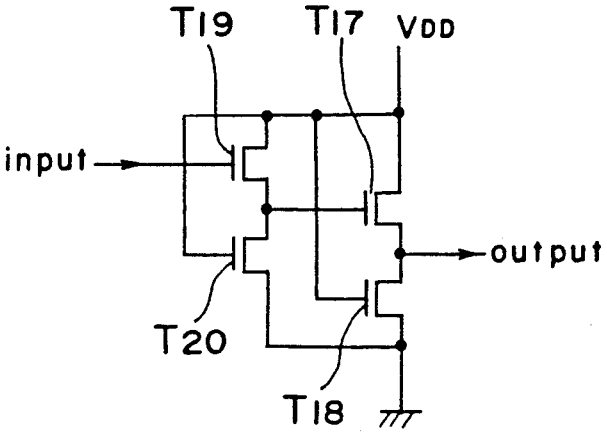

Also, FIG. 5 shows the other embodiment of the output circuit, wherein the third and fourth FETs T19 and T20 for load use and amplification use are connected in the same manner as in FIG. 4 to provide the two-stage construction.

In the above-described embodiments, the present invention is applied only upon the row driver. Needless to say, it may even be applied to the column driver.

Figure 6:
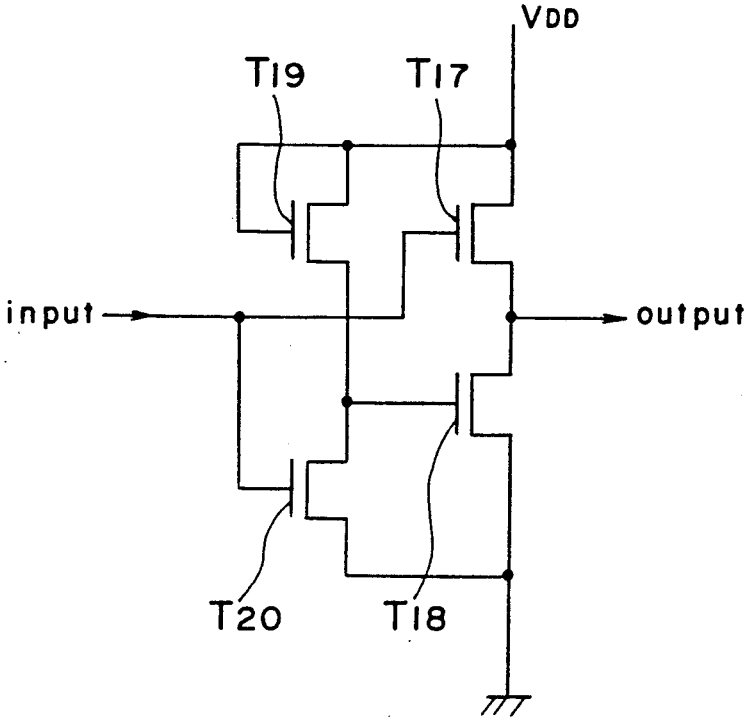

FIG. 6 shows a circuit diagram of one row portion of the output circuit in the present embodiment. The first and second FETs T17 and T18 for amplification are longitudinally connected between the power supply $V_{DD}$ and ground. The input signal is applied upon the gate of the first FET T17 so that the output signal is output from the connection point between the first and second FETs T17 and T18. The reversion output which has been reversed by the inverter composed of the third and fourth FETs T19 and T20 is applied upon the gate of the second FET T18.

The operation will be described hereinafter. When the input signal is high, the first FET T17 is turned on. The fourth FET T20 also becomes high at the gate to turn on the fourth FET so as to turn off the second FET T18. Thus, the output becomes high. At this time, the comparatively small current flows to the third and fourth FETs T19 and T20 which constitute the inverter, but the current does not flow to the output gate circuit constituted by the first and second FETs T17 and T18.

On the other hand, when the input signal is low, the first FET T17 is turned off and the second FET T18 is turned on, thus resulting in the low output. In the above case, the current does not flow into both the inverter and the output gate.

Namely, the current does not flow in the steady-state condition with the small amount of current flowing to the first and second FETs at the switching operation.

Accordingly, in the present embodiment, the current flows to the output circuit of one row portion selected from among two hundred forty rows, but the current does not flow at all to the output circuit of the other two hundred thirty-nine rows.

According to the embodiments, the power consumption in the driving circuit may be considerably reduced so as to make the image display apparatus for the liquid-crystal TV or the like smaller in size.

Figure 7:
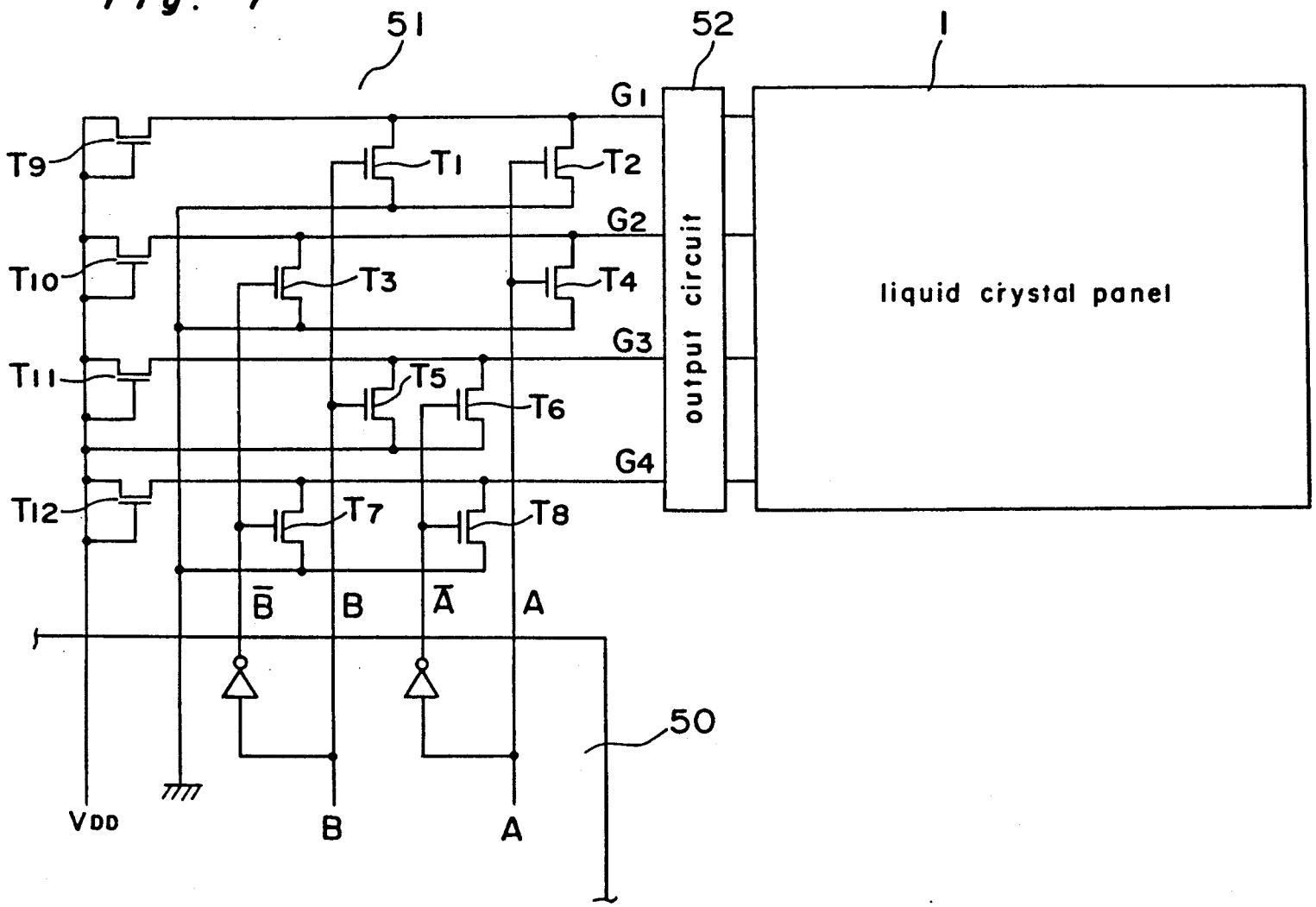
FIG. 7 and FIG. 8 are, respectively, circuit diagrams each showing a modification of the row driver of FIG. 1.

FIG. 7 shows the other embodiment of the first decoder. The first decoder 51 of the present embodiment is a NAND gate, wherein the TFTs T1 through T8 are disposed parallel to each row, with the advantage that the driving voltage may be made lower through the power consumption and the wiring number are a little more than in FIG. 2.

Figure 8:
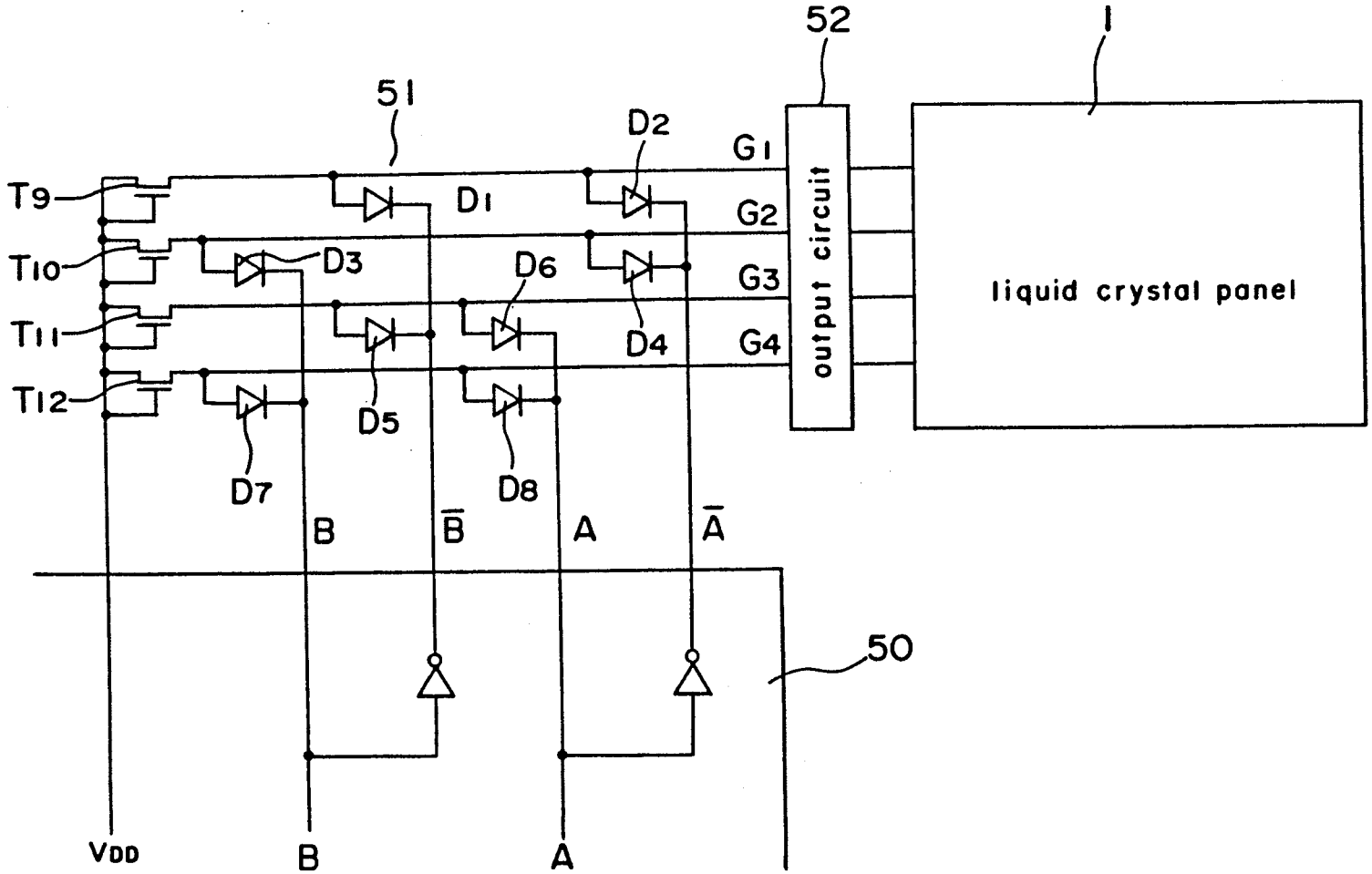

Furthermore, the other embodiment of the first decoder is shown in FIG. 8. The first decoder 51 of the present embodiment is an AND gate, where the diodes D1 through D8 are disposed parallel to each row, with the advantage that the driving voltage is lower and the number of the wirings is fewer though the power consumption is large.

Figures 2, 3:
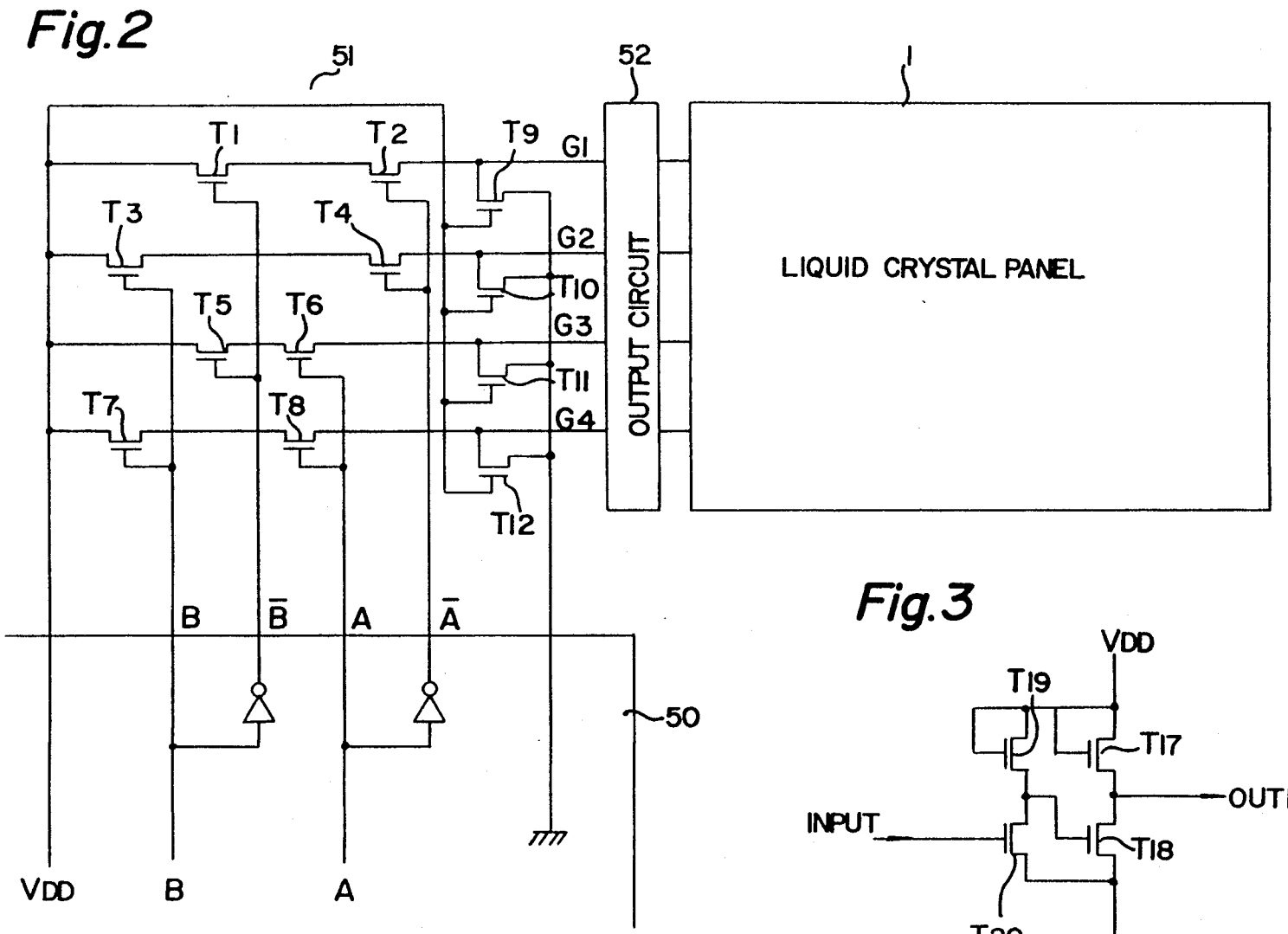
FIG. 2 is a circuit diagram showing the construction of the first decoder of FIG. 1.
FIG. 3 is a circuit diagram showing the construction of the output circuit of FIG. 2.

In FIG. 2, FIG. 7 and FIG. 8, although only a four row portion is shown for the first decoder for simplification the first decoder actually needs about 240 rows to increase the column number of the counters. Also, as the second counter 60 and the second decoder 61 in the column driver 6 are fundamentally similar in construction and operation to those of the row driver 5, they are not shown. According to the embodiments as described hereinabove, one portion of the driving circuit may be constructed on the same base plate as the switching transistor located within the active matrix panel and with the switching transistor of the same construction through the same process, so that the external circuit of the matrix panel may be considerably simplified and the connection wires between the matrix panel and the external circuit may be considerably reduced in number.

Figure 9:
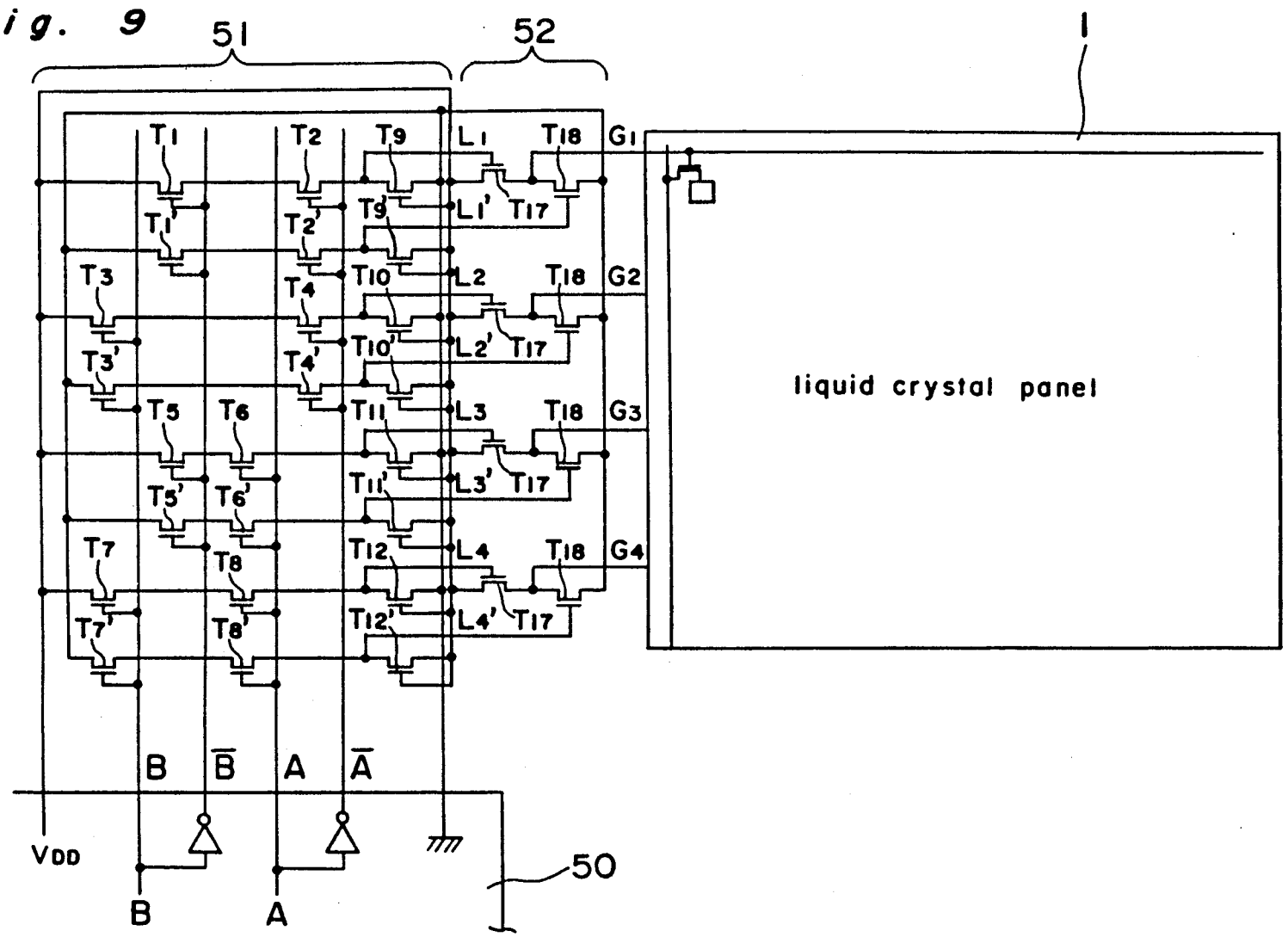
FIG. 9 and FIG. 10 are, respectively, circuit diagrams each showing the construction of the row driver of FIG. 1.

The other embodiment will be shown in FIG. 9 as the circuit of the row driver. Each code signal line of the binary count outputs A, B and inversion outputs $\overline{A}$, $\overline{B}$ from the first counter 50 is crossed in the matrix shape with respect to the lines L1 through L4 provided corresponding to each row G1, G2 of the matrix panel. The TFTs T1 through T8 constituting two AND gates are arranged for each row, so that the high is adapted to be output into each of the lines L1 through L4 when either of the respective rows G1, G2, ... is selected.

Also, each of the code signal lines is crossed in the matrix shape with respect to the adjacently disposed lines L1' through L4' in addition to the lines L1 through L4 corresponding to each row G1, G4, ... . The TFTs T1' through T8' are arranged similarly on each line, so that the low is adapted to be output upon each line L1' through L4' when either of the respective rows G1, G2, ... is selected. Namely, the output of the opposite phase appears on the adjacent two lines L1 and L1'.

The output circuit 52 is composed of a pair of longitudinally connected first and second FETs T17 and T18 for each row G1, G2, ..., with each row G1, G2, ... being connected from the connection point between both FETs. The lines L1 through L4 are combined with each gate of the first FET T17, the lines L1' through L4' are combined with each gate of the second FET T18.

The operation will be described hereinafter. Now, when the counter output is "00", both the A and B become "0", both the $\overline{A}$ and $\overline{B}$ become "1" to turn on the TFTs T1, T2, T4 and T5 and T1', T2', T4' and T5', so that the line L1 becomes high, the lines L2 through L4 become low, furthermore, the line L1' becomes low, the lines L2' through L4' become high. Accordingly, the first FET T17 turns on, the second FET T18 turns off to output the high output into the row G1. At this time, the first FETs of the other lines are all off, the second FETs thereof are all on with all the outputs being low.

Then, when the counter output is "01", the A, $\overline{B}$ become "0", the $\overline{A}$, B become "1" to turn on the TFTs T2, T3, T4 and T7 and T2', T3', T4' and T7', so that the line L2 becomes high, the lines L1, L3 and L4 are low, furthermore the line L2' becomes low, the lines L1', L3' and L4' become high. Thus, the first FET T17 of second row G2 turns on, the second FET T18 turns off to output the high output to the row G2.

As the counter outputs sequentially increase as described hereinabove, the next row sequentially becomes high and is selected to drive the TFT within the liquid-crystal panel of that row.

The driving operation of all the rows is completed to reset the first counter 50 by the next start signal, so that the next frame scanning operation is started.

Figure 10:
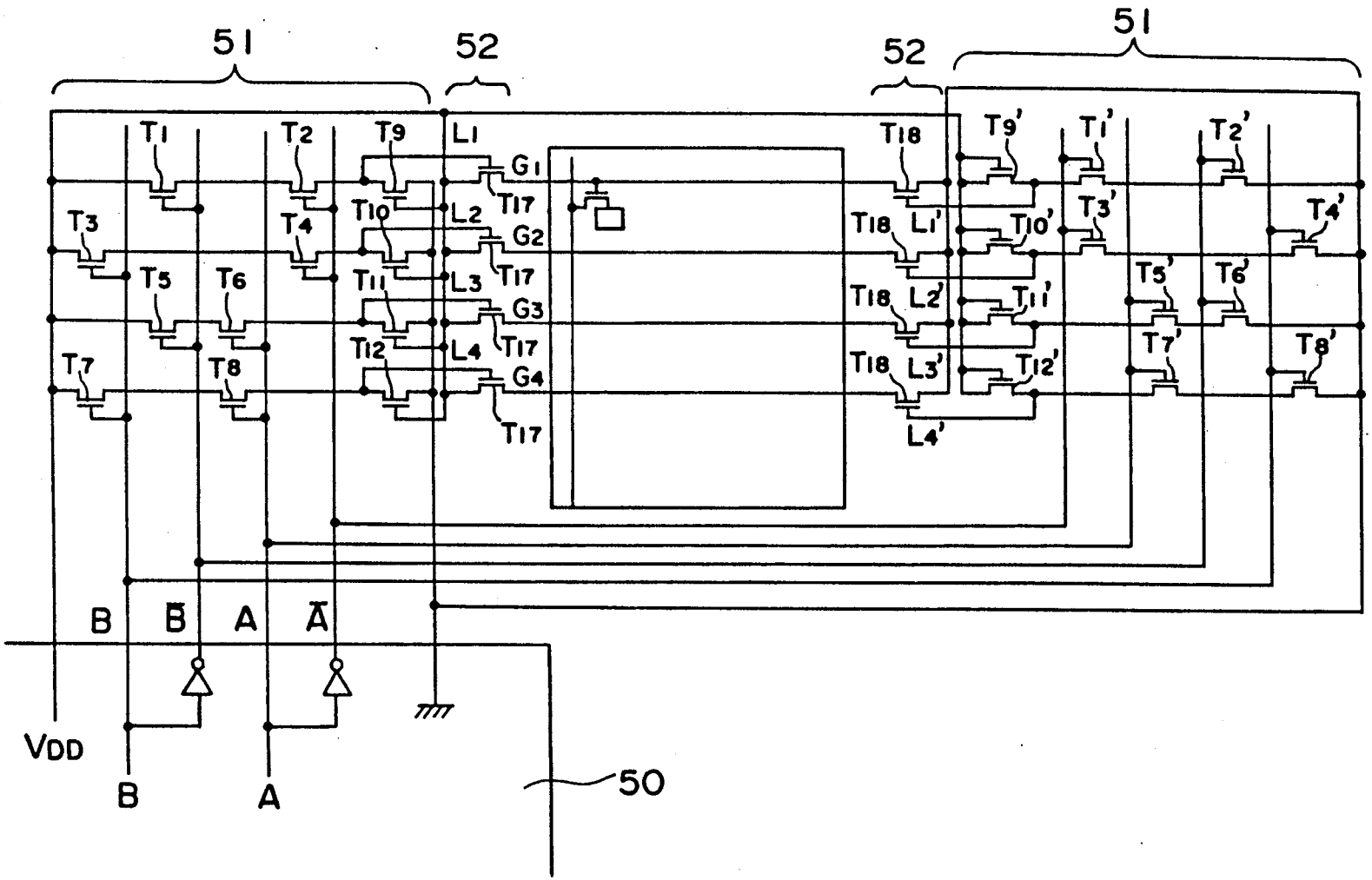

In the above-described row driver, the decoder simultaneously outputs two signals opposite in phase in accordance with each row to apply the completely opposite-phase signals upon each gate of the first and second FETs, so that the current does not flow at all in the steady-state condition. As the switching delay of one FET is not caused, both the FETs simultaneously do not turn on during the switching operation so that the large transient current does not flow. FIG. 10 shows the other embodiment of the row driver. In this embodiment, the first and second FETs T17 and T18 of decoder 51 and the output circuit 52 are respectively divided and disposed on both the sides of the liquid-crystal panel 1 and may be symmetrically arranged at right and left sides.

It is to be noted that the operation is completely the same as in FIG. 9.

The above-described two embodiments were the description in the row driver. It is clear that the present invention may be applied similarly even to the column driver.

According to the above-described embodiment, the current does not flow at all under the steady condition in the output circuit and the large transient current does not flow even during the switching operation, so that the power consumption of the driving circuit may be reduced. Also, the switching time does not become longer than necessary.

(Second Embodiment)

Figure 11:
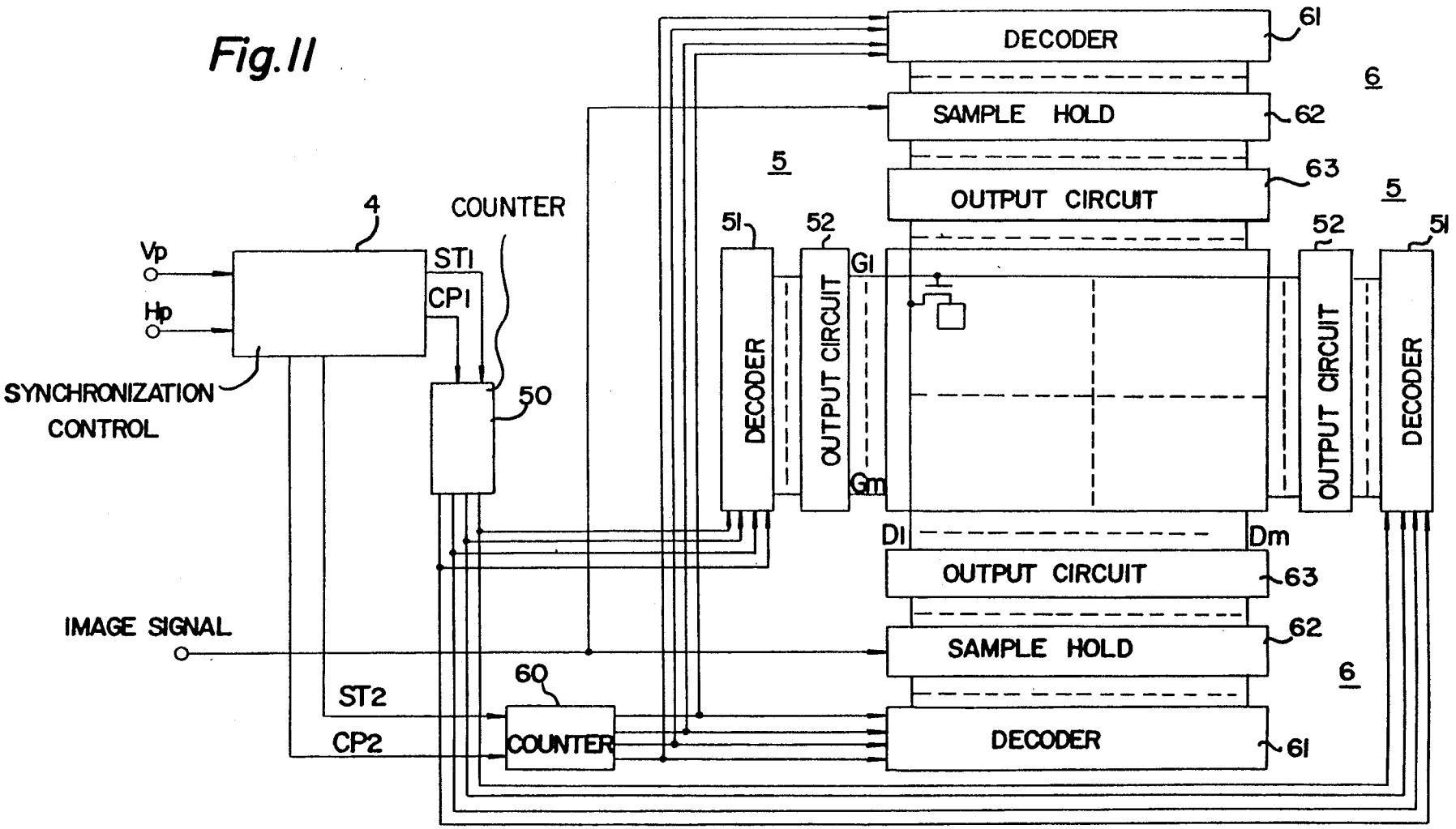
FIG. 11 is a block diagram showing a driving circuit for the liquid-crystal display apparatus as a second embodiment of the present invention.

FIG. 11 is a block diagram showing the driving circuit of the liquid-crystal display apparatus in the other second embodiment. The same reference characters are given to the same portions as in FIG. 1 with the description being omitted.

Referring to FIG. 11, a first counter 50 starts the counting operation of the first clock pulse CP1 by the first start pulse ST1 from the synchronization controlling circuit 4 to output the binary count outputs A, B and the inversion outputs $\overline{A}$, $\overline{B}$. The first decoders 51, 51 decode the first counter outputs to respectively output the pulses, which sequentially become high for each of the first clock pulses CP1 to the right and left of each row G1, G2, ... . A second counter 60 outputs the binary counter outputs in accordance with the second start pulse ST2 and the second clock pulse CP2 from the synchronization controlling circuit 4. The second decoders 61, 61 respectively output the pulses, which sequentially become high for each of the second clock pulses CP2 upwardly and downwardly of each column D1, D2, ... through the decoding operation of this second counter output. Thus, the row driver 5 is composed of the first counter 50, the first decoder 51 and the output circuit 52. The column driver 6 is composed of the second counter 60, the second decoder 61, the sample holding circuit 62 and the output circuit 63. The first and second decoders 51 and 61, the output circuits 52 and 63, and the sample holding circuit 62 are formed on the same base plate as the liquid-crystal panel 1 and through the same process by the a-Si TFT.

The circuit of the first decoder and the operation of the line driver will be described in FIG. 12. The respective rows of the binary count outputs A, B and these inversion outputs $\overline{A}$, $\overline{B}$ from the first counter 50 are crossed in the matrix shape with respect to the respective rows G1, G2, ..., with two TFTs constituting the AND gate being disposed in series on the respective rows. In addition, the loads TFTs T9 through T12 are connected with the respective rows with the output circuit 52 being connected with the output for each of the rows.

Now, when the counter output is "00", both the A, B are "0", both the $\overline{A}$, $\overline{B}$ become "1" to turn on the TFTs T1, T2, T4 and T5, so that only the row G1 becomes low. Then, when the counter output is "01", both the A, $\overline{B}$ are "0" and both the $\overline{A}$, B become "1" to turn on the TFTs T2, T3, T4, T7, so that the row G2 becomes low. As the counter output sequentially increases like this, the next row sequentially becomes low so as to be selected and is amplified in inversion by the output circuit of the next stage, so that the TFT within the liquid-crystal panel of this row is driven.

When the driving operation of all the rows is completed to reset the first counter 50 by the next start signal, the scanning operation of the next frame is started.

Figure 12:
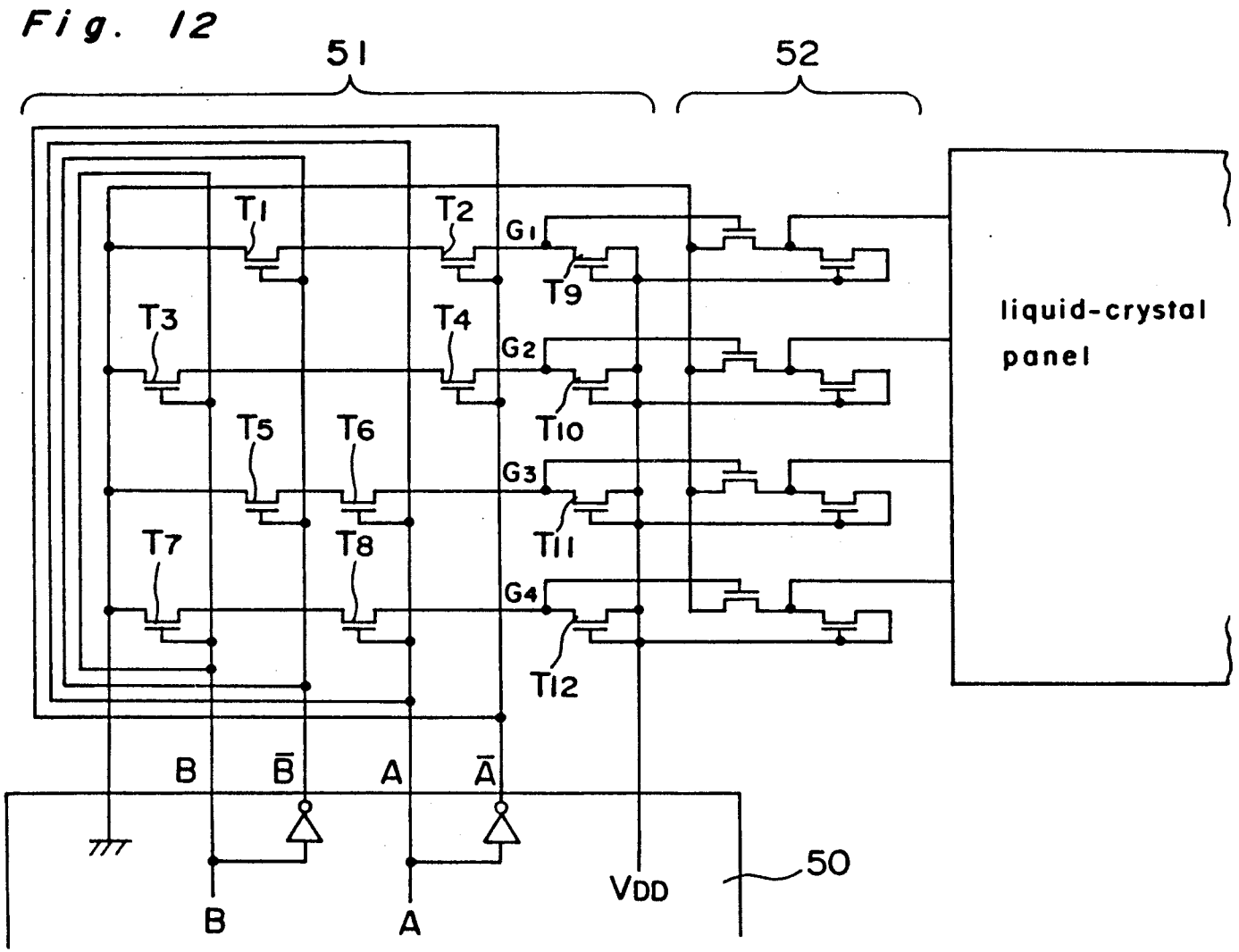
FIG. 12 is a circuit diagram showing the construction of the first decoder of FIG. 11.

Although the decoder 51 and the output circuit 52 are shown only in the left-hand side portion of FIG. 12, they are really arranged symmetrically on right and left sides as shown in FIG. 11, with one row being driven by the same signal from the right and left.

Accordingly, even if the scanning line of the liquid-crystal panel 1 is disconnected somewhere at one location, the signals are fed into the entire rows, because the signals are fed from both sides of the rows, so that the displaying operation is completely performed. Also, when the scanning line and the signal have been short-circuited somewhere in the active matrix, the line defects may be changed into the point defects because of the cutting operation of that portion at two locations, the signal line is crossed on the scanning line.

A case where the fault has occurred on the side of the decoder will be described hereinafter. First, where the short-circuit has been caused between the code signal line from the counter and the line of the AND gate of the decoder, the fault is not caused because of the supply of the output from the other decoder if the line wiring of the AND gate is cut on both lines of the code signal. Also, even if the line of the AND gate is disconnected somewhere, the compensation may be performed by the output of the other decoder in the same manner as described hereinabove.

Furthermore, if the disconnection is caused on the code signal line of the decoder, the operation is not interfered with, because the code signals are fed from above and below the matrix.

In addition, when the disconnection has been caused at two locations on the code signal line, the fault line becomes open if the output line of the output circuit corresponding to the gate line existing between the two lines is cut with a laser or the like, so that the driving operation may be effected with the signal from the other decoder.

It is clear that the method of applying the code signal from above and below the matrix of the decoder as described hereinabove may be similarly applied to the decoder 61 of the column driver.

According to the embodiment, the operation may be effected without-hindrance if the failures such as disconnection, short-circuit or the like occur on the matrix panel or within the driving circuit during the manufacturing process, so that the yield may be considerably improved as compared with the conventional one with the shift register being used in the driving circuit.

Figure 13:
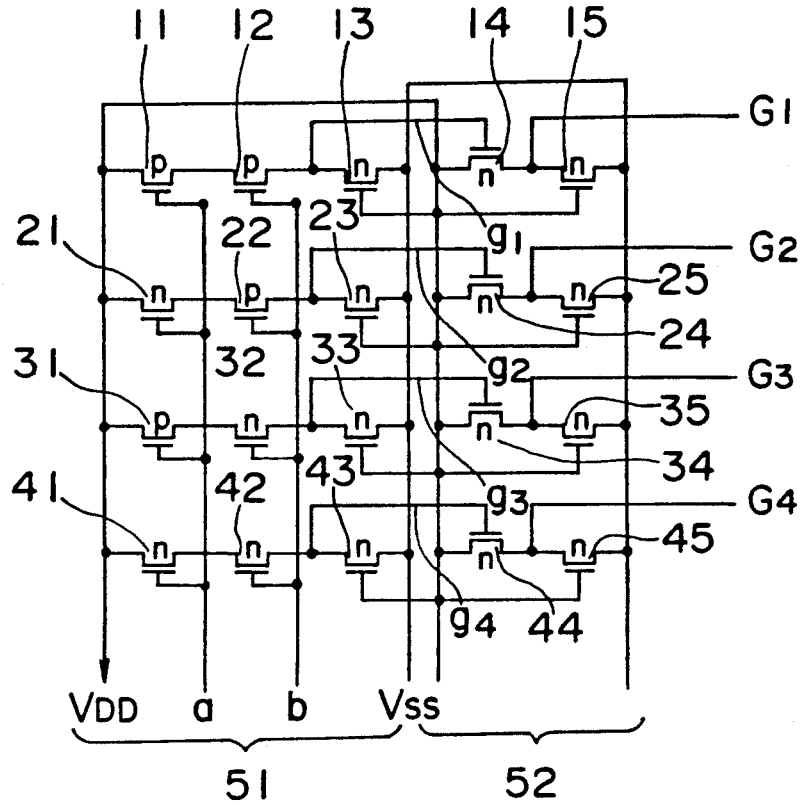
FIG. 13 is a block diagram showing a driving circuit for the image displaying apparatus as a third embodiment of the present invention.
Figure 14:
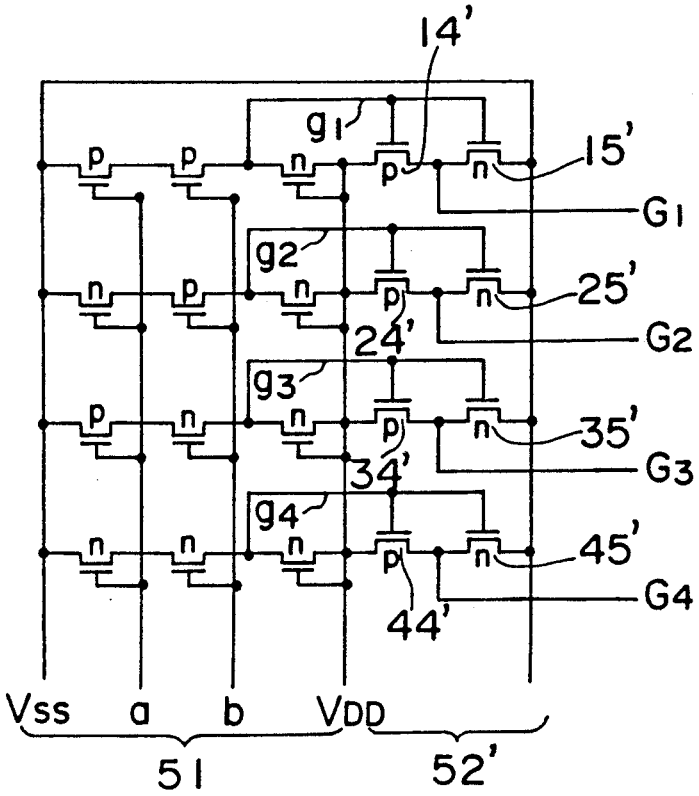
FIG. 14 is a block diagram showing a modification of FIG. 13.
Figure 15A:
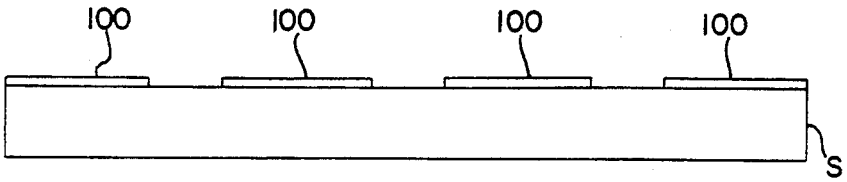
FIGS. 15(*a*) through 15(*f*) are drawings showing the processes for forming on the same base plate the p channel TFTs and the n channel TFTs in the circuit of FIG. 13.
Figure 15B:
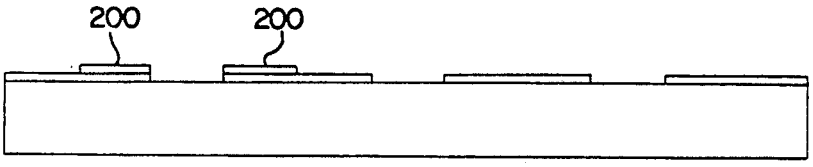
Figure 15C:
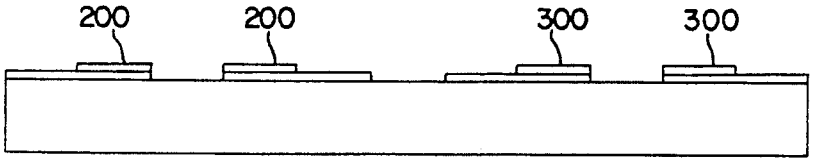
Figure 15D:
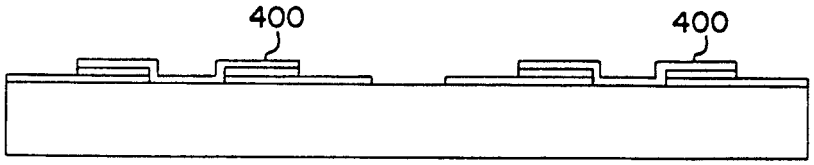
Figure 15E:
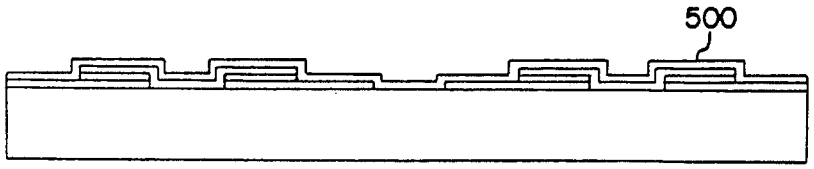
Figure 15F:
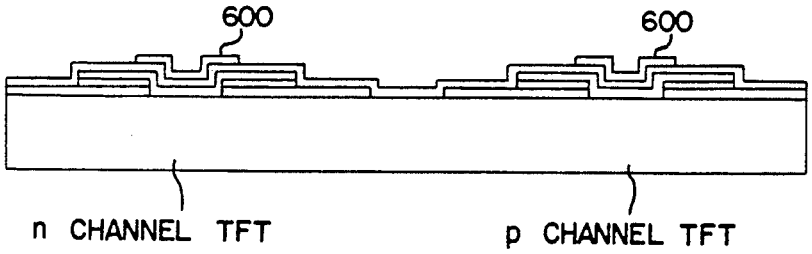
Figure 18:
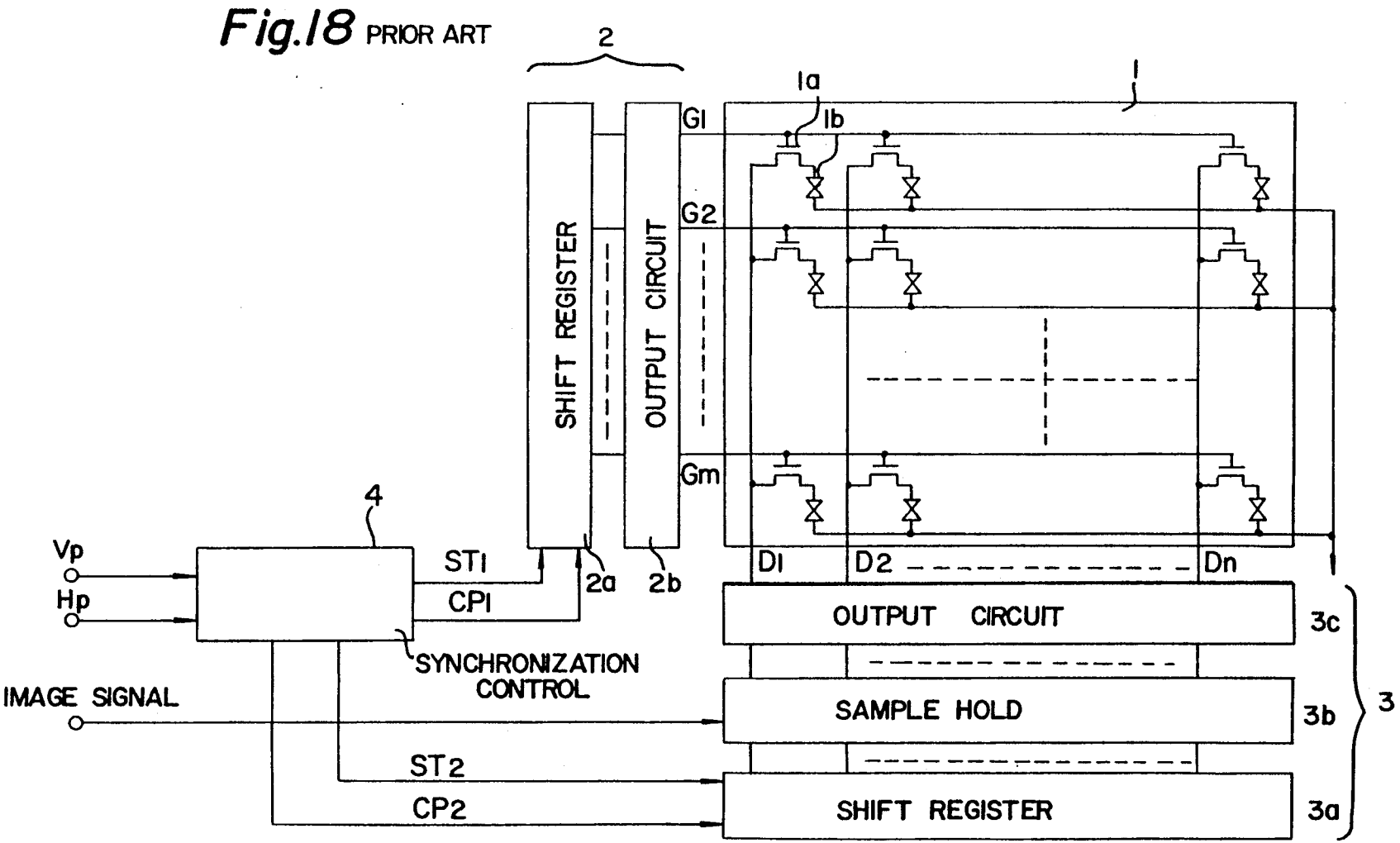
Fig.18 PRIOR ART
FIG. 18 is a block diagram showing the driving circuit of the conventional liquid-crystal display apparatus.
Figure 19:
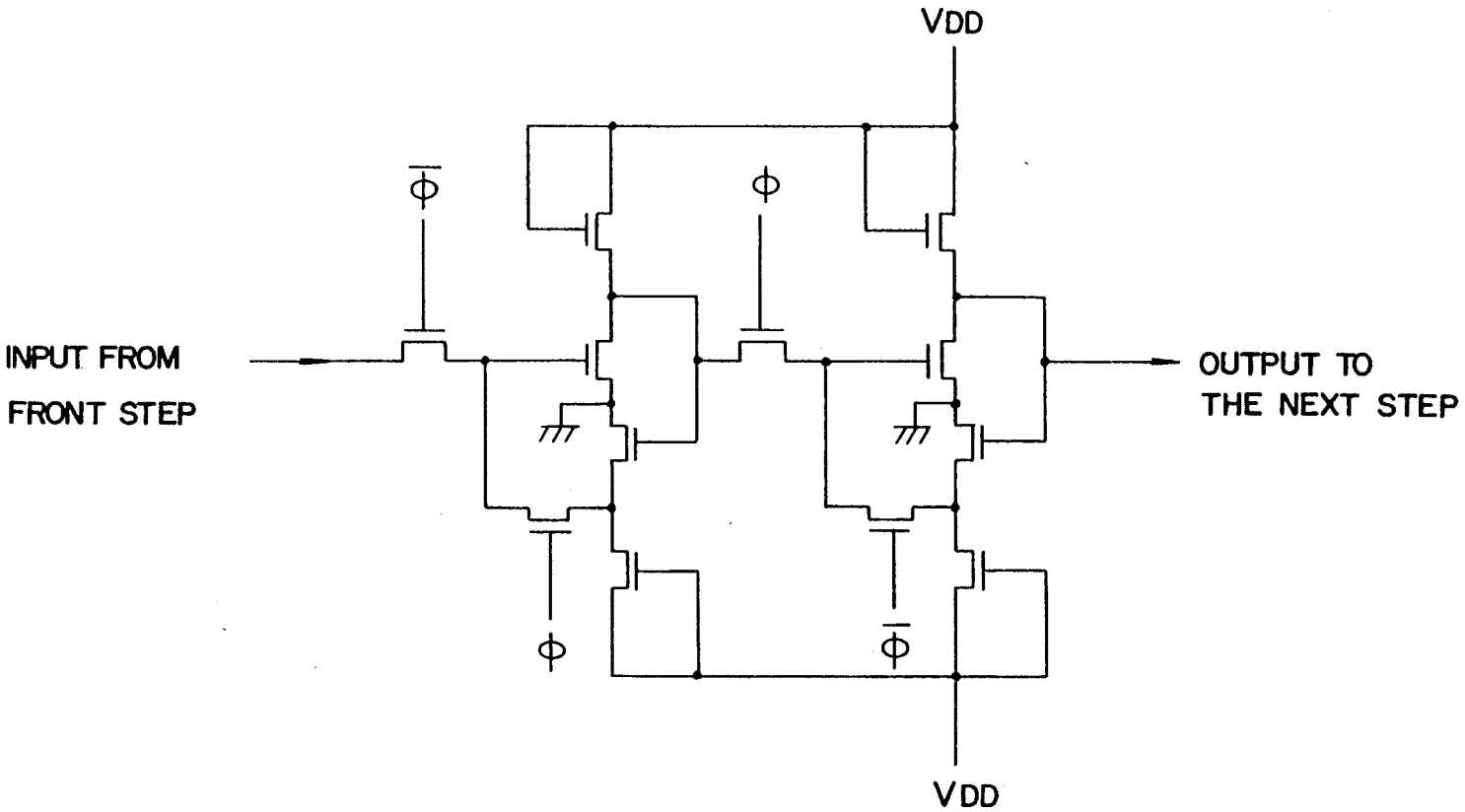
Fig. 19 PRIOR ART
FIG. 19 is a circuit diagram showing the construction of the shift register of FIG. 18.

The third embodiment wherein the driving circuit of the picture display apparatus of the present invention is shown in FIG. 13 and FIG. 14. Referring to FIG. 13, the first bit a of the binary count is connected with each gate of the p type TFTs 11 and 31 of the first and third row signal lines, of the n type TFTs 21 and 41 of the second and fourth row signal lines, the second bit b is connected with each gate of the p type TFTs 12 and 22 of the first and second row signal lines, of the n type TFTs 32 and 42 of the third and fourth row signal lines.

The counter 50 is composed of two-bit four-output construction. If the true values have been set that the outputs are a="0", b="0" when the counter is 0, the outputs are a="1", b="0" when the counter is 1, the outputs are a="0", b="1" when the counter is 2 , the outputs are a="1", b="1" when the counter is 3, the negative voltage signal corresponding to the "0" turns on the p channel TFT, the positive voltage signal corresponding to the "1" turns off the n channel TFT in the decoder 51. Accordingly, as the TFTs 11, 12, 22 and 31 turn on, the TFTs 21, 32, 41 and 42 turn off when the counter is 0, only the first output signal G1, with the TFTs 11 and 12 of ON condition being operated, among four outputs G1 through G4 from the decoder 51 becomes high. Accordingly, as the TFT 14 turns on in the output circuit 52 composed of n channel TFTs 14, 15, 24, 25, 34, 35, 44 and 45, only the first gate G1 among four gate signals G1 through G4 becomes high Then, when the counter 50 advances from 0 to 1, the TFTs 12, 21, 22 and 41 of the decoder 51 turn on, the TFTs 11, 31, 32 and 42 turn off to make only the output signal G2 high, so that only the gate signal G2 becomes high.

As the counter 50 advances like this, the gate signals G1 through G4 sequentially become high to drive the liquid-crystal panel.

Also, in the embodiment of FIG. 14, the output circuit 52' is different from that of the embodiment of FIG. 12. Namely, the circuit 52' complementarily connects the p channel TFTs 14, 24, 34 and 44 with the n channel TFTs 15, 25, 35 and 45. As the TFTs of the p channel TFTs or the n channel TFTs are off with the exception of the switching operation time, the current consumption is smaller.

The process of forming the p channel TFTs and the n channel TFTs on the same base plate, i.e., the active matrix panel, is shown in FIG. 15. As shown in FIG. 15(*a*), the conductive layer 100 composed of ITO or gold which becomes the source of the TFT and the drain electrode is attached on the glass base plate s of the active matrix panel to perform the patterning operation on the given pattern with photo-lithography. As shown in FIG. 15(*b*), the n type of amorphous silicon which become the source, drain electrodes 200, 200 of the n channel TFTs are attached to perform the patterning operation. The p type of amorphous silicon which becomes the source, drain electrodes 300, 300 of the p channel TFTs are attached on them to perform the patterning operation as shown in FIG. 15(*c*), the former n type of amorphous silicon, 200 may remain.

Furthermore, as shown in FIG. 15(*d*), the i type (genuine) amorphous silicon which become the operation regions 400 of both the TFTs are attached to perform the patterning operation. As shown in FIG. 15(*e*), insulating film such as $SiO_2$, $Si_3N$ or the like which becomes the gate insulating film 5 is attached thereon. Finally, as shown in FIG. 15(*f*), a conductive layer such as aluminum which becomes a gate electrode 600 is attached to perform the patterning operation.

In the above description, the present invention is embodied about the driving circuit on the side of the gate signal line. Needless to say, it may be adopted on the driving circuit on the side of the drain signal line.

According to the picture display apparatus of the present embodiment, the decoder is composed of the combination circuit between the p channel thin film transistor and the n channel thin film transistor so that the decoding operation may be-performed by the use of the binary count value from the counter without the use of the inversion output. Thus, the input lines from the counter into the decoder are halved in number to simplify the construction of the decoder and to improve the yield.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed a being included therein.

What is claimed is:

1. A driving circuit for an image display apparatus of a panel with a plurality of picture elements disposed in a matrix shape, said driving circuit comprising:

a circuit generating pulses which sequentially shift in a synchronous relation with clock pulses to sequentially select, at a period of the clock pulse of a given frequency, respectively each row and/or each column of the panel; and an output circuit amplifying the pulses to output to said panel, said output circuit including a first FET in which said pulses are input to a gate, and a second FET connected in series with the first FET and in which signals opposite in phase to said pulses are to be input to a gate, so that an output signal is output from a connection point of both FETs.

2. A driving circuit for an image display apparatus of an active matrix panel, with a plurality of picture elements being disposed in matrix shape, respective rows and columns of said active matrix panel are respectively selected by a clock pulse of a given frequency to drive each of said picture elements, the driving circuit comprising:

a counter counting said clock pulses and outputting binary count values and inverted binary count values for said respective rows and columns;

a decoder decoding the binary and inverted binary count value from the counter to simultaneously generate a pair of pulses opposite in polarity, said pair of pulses sequentially shifting in a synchronous relation to said clock pulses in each of said respective rows and/or respective columns; and an output circuit including first and second FETs being connected in series, a pair of pulses opposite in polarity being applied respectively upon each gate of each FET, output signals amplified from connection points of both FETs being output to said active matrix panel.

3. A driving circuit for an image display apparatus of an active matrix panel, with a plurality of picture elements being disposed in matrix shape, respective rows and/or columns of said active matrix panel are respectively selected by clock pulses of a given frequency to drive the respective picture elements, the driving circuit comprising:

a counter counting said clock pulses and outputting binary count values and inverted binary count values; and a pair of decoders are respectively connected at both ends of each of the rows and/or both ends of each of the columns, the decoders decoding the binary and inverted binary count values of the counter to generate pulses, in each of said rows and/or in each of said columns, which sequentially shift in a synchronous relation with said clock pulses, said decoders are formed of a-si thin film transistors.

4. A driving circuit for an image display apparatus of an active matrix panel, with a plurality of picture elements being disposed in matrix shape, respective rows and/or columns of said active matrix panel are respectively selected by clock pulses of a given frequency to drive the respective picture elements, the driving circuit comprising:

a counter counting said clock pulses and outputting binary count values and inverted binary count values; and a decoder decoding the binary and inverted binary count values of the counter to generate pulses, to each of said rows and/or each of said columns, which sequentially shift in a synchronous relation with said clock pulses to feed said binary and inverted binary count values of said counter from both ends of a code signal line of said decoder, said decoder formed of a-Si thin film transistors.

5. An image display apparatus of an active matrix panel, with a plurality of picture elements being disposed in a matrix shape, respective rows and/or columns of said active matrix panel are respectively selected by clock pulses of a given frequency to drive each of said picture elements, the image display apparatus comprising:

a counter which counts said clock pulses and which outputs binary count values; and a decoder which decodes the binary count values of the counter to generate pulses, in each of said rows and/or each of said columns, which sequentially shift in a synchronous relation with said clock pulses, both the counter and the decoder being disposed on said active matrix panel, said decoder being composed of an a-Si p channel thin film transistor and an a-Si n channel thin film transistor, which responds to the binary count value of the counter.

6. The image display apparatus in accordance with claim 5, wherein the output circuit of the decoder is composed of the the a-Si p channel thin film transistor and the the n channel thin film transistor.

* * * * *